US009377016B2

(12) United States Patent
Bach et al.

(10) Patent No.: US 9,377,016 B2
(45) Date of Patent: Jun. 28, 2016

(54) SYSTEM AND METHOD FOR HOLDING TUBING FOR A PERISTALTIC PUMP

(71) Applicants: David T. Bach, Manchester, NH (US); James J. Bach, Manchester, NH (US)

(72) Inventors: David T. Bach, Manchester, NH (US); James J. Bach, Manchester, NH (US)

( * ) Notice: Subject to any disclaimer, the term of this patent is extended or adjusted under 35 U.S.C. 154(b) by 298 days.

(21) Appl. No.: 14/033,183

(22) Filed: Sep. 20, 2013

(65) Prior Publication Data

US 2014/0170004 A1 Jun. 19, 2014

Related U.S. Application Data

(63) Continuation-in-part of application No. 13/114,266, filed on May 24, 2011, now abandoned.

(60) Provisional application No. 61/396,049, filed on May 24, 2010.

(51) Int. Cl.
*F04B 43/08* (2006.01)
*F04B 43/12* (2006.01)

(52) U.S. Cl.
CPC ..... *F04B 43/1253* (2013.01); *F04B 43/1261* (2013.01); *F04B 43/1292* (2013.01); *F04B 43/1215* (2013.01)

(58) Field of Classification Search
CPC ..... F04B 43/1253; F04B 43/1215; F04B 43/0072
USPC ..... 417/476, 477.1, 477.13
See application file for complete search history.

(56) References Cited

U.S. PATENT DOCUMENTS

| | | | | | |
|---|---|---|---|---|---|
| 1,848,024 | A | | 3/1932 | Owen | 417/477.8 |
| 3,140,666 | A | | 7/1964 | Currie | 417/477.11 |
| 3,172,367 | A | | 3/1965 | Kling | 417/475 |
| 3,353,491 | A | | 11/1967 | Bastian | 417/477.9 |
| 3,402,673 | A | | 9/1968 | Ballentine et al. | 417/477.1 |
| 4,181,476 | A | | 1/1980 | Malbec | 417/477.3 |
| 4,552,516 | A | * | 11/1985 | Stanley | F04B 43/1253 24/517 |
| 4,906,168 | A | * | 3/1990 | Thompson | F04B 43/1253 417/476 |
| 4,969,808 | A | * | 11/1990 | Tsukada | F04B 43/1253 417/477.1 |
| 6,406,267 | B1 | | 6/2002 | Mondiere | 417/53 |
| 7,037,092 | B2 | * | 5/2006 | Kagawa | F04B 43/1276 417/476 |
| 7,513,757 | B2 | | 4/2009 | Gibson et al. | |
| 7,918,657 | B2 | * | 4/2011 | Bobo | F04B 43/1253 384/548 |
| 8,052,403 | B1 | * | 11/2011 | Becher | F04B 43/1215 417/477.13 |

* cited by examiner

*Primary Examiner* — Peter J Bertheaud
(74) *Attorney, Agent, or Firm* — Clifford H. Kraft

(57) ABSTRACT

A "load and go" peristaltic pump tubing arrangement without a special configuration, such as the "Double-Y" tubing connectors used by the Watson Marlow 505L pump head. One of the critical components in the peristaltic pump system is the pump tubing which now can be monitored so that the health of the peristaltic pump is known. The result is a "smart" peristaltic pump using a notch or other part in a second spring-clamp or tubing holder. Located on two ⅛ 316 inch shoulder screws are two roller clutches and two spacers to complete the assembly of the pump. The distance between the two rollers allows the tubing to elongate but not move backward toward the peristaltic rollers.

5 Claims, 7 Drawing Sheets prior art

SYSTEM AND METHOD FOR HOLDING TUBING FOR A PERISTALTIC PUMP

This is a continuation in part of application Ser. No. 13/114,266 filed May 24, 2011 which claimed priority from U.S. Provisional Patent Application No. 61/396,049 filed May 24, 2010. Applications Ser. No. 13/114,266 and 61/396,049 are hereby incorporated by reference in their entireties.

BACKGROUND

1. Field of the Invention

The present invention relates generally to peristaltic pumps used in the bio-sciences and more particular to a system and method for holding tubing for a peristaltic pump the prevents tubing stretch or deformation.

The present invention compensates for tube stretching and minimizes tube deformation due to peristaltic roller tube expansions.

2. Description of the Prior Art

Fluid dispensing in the pharmaceutical and other markets such as biotechnology are moving away from positive piston pumps and moving to peristaltic pump systems. The main driving force is that peristaltic pump systems do not create shear in the fluid being pumped, and the cleaning validation is simplified as compared to positive piston displacement systems. In sealless positive displacement pumps, it has been demonstrated that the fluid experiences shear forces that have an adverse effect on delicate cell structures.

Peristaltic pumps use a series of rollers to compress tubing that passes through the pump to move a fluid. There are many companies that make peristaltic pumps such as Watson-Marlow, Flexicon and Masterflex, and they all use the same principle of compressing tubing to advance fluid. It has been demonstrated in numerous studies that the use of a peristaltic pump allows for the effective handling of protein and cell structures without the shear forces of piston pumps. Peristaltic pumps have a fluid path only consisting of the tubing that can easily be sterilized, and in many cases discarded after use. This makes the cleaning validation much simpler and reliable.

As peristaltic pumps are being used more for various products, there is a need to carefully support and control the tubing that is being used in the pump Peristaltic pump tubing needs to be held at the input to the peristaltic pump so that when the tubing is compressed it does not advance into the pump. Some manufacturers such as Watson-Marlow and others use tubing clamps and a Y-structure that is must be carefully inserted around two fixed posts, one post being at the input and the other at the output. When such tubing clamps are used, they can have a negative effect of restricting the flow due to sizing or if tightened too much. There are a number of attachment devices known in the art designed to secure and hold tubing, but none of the systems provides for tubing elongation when the peristaltic pump is exercised. Action of the pump can force the tubing to elongate in the direction of rotation. This can be seen in the field where the Y is stretched around the two fixed posts at before running, but after running, the tubing is loose at the output post. If individual tubes holders are used, the output clamp will exhibit a loose-tube condition present as the tube stretches during use. In some units such as the Colanar peristaltic pump FSP-1001, the rollers are geared so that the forward stretching is less than in non-geared systems; nevertheless, elongation still takes place. Tubing stretch occurs in all peristaltic pump systems, and none of the systems currently known in the art have a way of compensating for this stretch. Many of the systems offer a drip retention or suck-back feature where the rollers in the pump are reversed at the end of a pump run in order to move the fluid back into the output tubing. In these cases, drip retention is part of the relaxing of the tube elongation and movement of fluid back into the tube. Tube stretching and relaxing leads to a loss of accuracy since it has the effect of causing variability in each fill.

It would be advantageous to have a system and method of holding the tubing in a peristaltic pump where the input side is held fixed, but there is no restriction introduced into the fluid passage. Also, the output part of the system needs to compensate for tube elongation.

The Watson Marlow 505 type peristaltic pump uses a "Double-Y" set of peristaltic tubing that is secured in the pump by stretching the tubing set over a set of retention pegs. The distance is predetermined and if single tubes are used in the 505L the nominal distance between tubing clamps is 145 mm for bore sizes up to 8.0 and 150 mm for 9.6 mm bore tubes. In most cases each peristaltic tube is held firmly at the input to the peristaltic pump and slightly stretched and secured with output clamps. Shown in FIG. 4 are Double-Y tubing sets from Watson Marlow that are inserted into the peristaltic pump.

These tubing sets are stretched over the retention pegs as shown in FIG. 5. When using Marprene tubing the 505Di pump the tubing must be readjusted: "after the first 30 minutes of running, re-tension the tube in the pump head by releasing the tube clamp on the delivery side a little and pulling the tube tight. This is to counteract the normal stretching that occurs with Marprene which can go unnoticed and result in poor tube life."

All manufacturers use some form of mechanical clamp to secure the input and output tube at fixed positions. In FIG. 6 is the Watson Marlow 314D pump head with adjustable clamps on both sides of the pump for the input and output tubes.

The Masterflex series of pumps also uses mechanical locks for their tube sets but in each case they are fixed in place so they do not compensate for tube elongation.

Gibson and Bannistar use a method of tube races to secure the tubing and assure that it stays aligned. U.S. Pat. No. 7,513,757 describes a different method of tube holding.

It would be advantageous to have a system and method where the tubing can elongate, the mechanism will not restrict the elongation but will compensate and measure the elongated tubing. The tubing is also restricted so that movement backwards or during a "suck back" operation can't take place due to one direction bearings. If the tubing is small in diameter and does not possess the necessary elongation force to feed the holding mechanism the use of advancing forces are available from the elongation measuring system.

SUMMARY OF THE INVENTION

The present invention relates to an enhancement for a peristaltic pump that, in a particular embodiment, can be a thin concave spring member or other mechanism with at least one tubing notch adapted to be mounted on a peristaltic pump frame such that peristaltic pump tubing can pass through a notch in the spring member, through the peristaltic pump and through a notch in a similar thin concave spring member mounted on an opposite side of said peristaltic pump so that the spring members prevent tube-stretching or deformation of the tubing. Numerous other embodiments are possible. The embodiments of the present invention allow attaching a first and second notched spring-clamp or other tubing holder on the input and output sides of a peristaltic pump frame; threading peristaltic pump tubing through a notch or other part in a first spring-clamp or tubing holder, through the peristaltic pump and through a notch or other part in a second spring-clamp or tubing holder. Generally the spring members are spring steel, but any rigid, partially elastic material can be used. In some embodiments of the invention, the peristaltic pump tubing changes diameter near the tubing holders. A common way of having the tubing holders hold the tubing is to use spring members that each contain one or more notches. The present invention can accommodate from 1 to n tubes, where n is a positive integer.

The present invention allows the user to "load and go" peristaltic pump tubing without a special configuration, such as the "Double-Y" tubing connectors used by the Watson Marlow 505L pump head. One of the critical components in the peristaltic pump system is the pump tubing which now can be monitored so that the health of the peristaltic pump is known. The result is a "smart" peristaltic pump.

The present invention can exist as a linear or rotary peristaltic pump configuration with any number of pump tube channels, tube sizes or number of peristaltic rollers in a given system. The input and output tube holding devices allow for tube elongation due to the peristaltic rollers. Located on two ⅛ 316 inch shoulder screws are two roller clutches and two spacers to complete the assembly. The distance between the two rollers allowed the tubing to elongate but not move backward toward the peristaltic rollers. It takes approximately three cycles to elongate the silicon tubing. The tubing is held in this position until the operator opens the pump.

A particular embodiment of the present invention is a tube holding device for a peristaltic pump that allows for elongation of peristaltic pump tubing without letting the tubing move backward that includes a frame holding a peristaltic pump, a pair of substantially cylindrical roller gears mounted on the frame, the roller gears having longitudinal teeth or being knurled, and positioned to cooperate with the peristaltic pump by clamping a peristaltic pump tube between them. At least one of said roller gears can be attached to a negator spring located in a string pot where the negator spring assists in providing force between said roller gears for small tubing. The device can have a tube-holding member attached to the frame where the tube-holding member is concave to cause the tubing to center on the roller gears.

DESCRIPTION OF THE FIGURES

Illustrations are now presented to aid in understanding features of the present invention.

Figure 1:
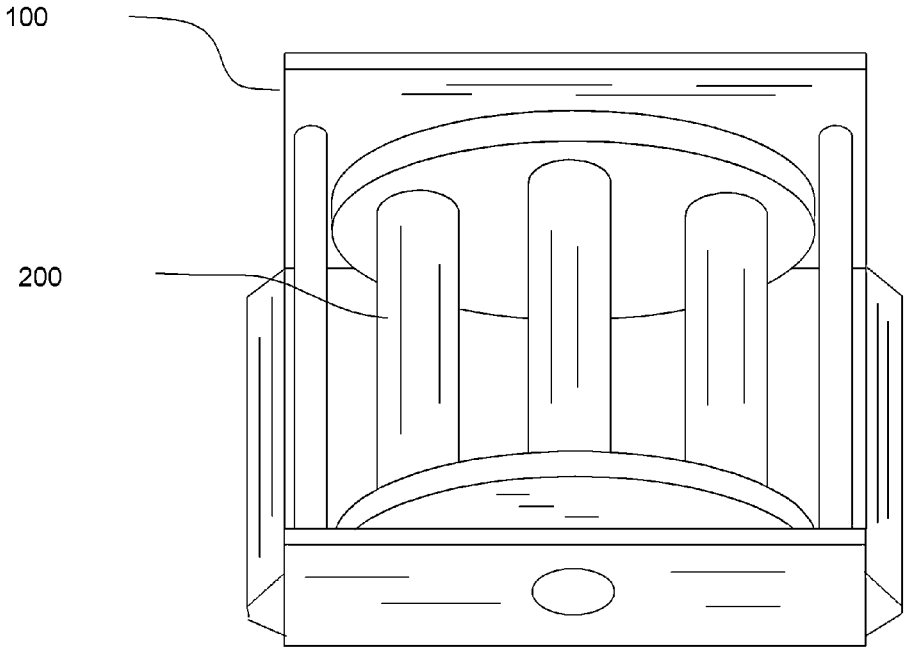
FIG. 1 shows a prior art peristaltic pump.

Several drawings and illustrations have been presented. The scope of the present invention is not limited to what is shown in the figures.

DESCRIPTION OF THE INVENTION

The present invention relates to a spring loaded input and output tube holder for peristaltic pump tubing that will provide a tension while holding the tubing in an elongated position. The tube holder provides for a constant tension and can also have a ratchet mechanism so that the tubing can not slip backward. The invention allows for from one to n tubes to be placed in a peristaltic pump, be properly supported at the input side, and each tube being able to go straight through the peristaltic pump. The tubing in a Watson-Marlow Y-configuration does not go through the pump in a straight fashion; this can result in excessive tubing wear. The present invention cures this problem. The output side has a tube holder providing constant tension, with or without a ratchet mechanism, and is aligned so that each tube runs straight through the peristaltic pump. The tension device can be designed for single tube or multiple tube tensioning. The initial tension in the output device can be as low as zero where the tubing elongation itself provides the necessary force through a non-reversing output tube holding mechanism.

There is a progression of rollers that takes place during sequential dispensing with a typical peristaltic pump. When the release roller is not at the exit of the shoe, the amount of material flow-back can increase. If on the other hand the roller is at the exact exit of the shoe compression when the end of a cycle occurs, the amount of material flow-back is at a minimum. If the rollers are at the earliest point in the shoe compression when the cycle is ended, the elongation will cause flow-back to be maximum. This change in elongation results in variability in the dispensing results. If suck-back or drip-retention is used, this effect is much greater. The tension provided by the present invention, with or without a ratchet-forward device, solves this problem by not allowing excess extension of material to flow back to the rollers when the pump is stopped.

The present invention includes a fixed input holder and an output holder that provide a tension to the output tube. In a particular embodiment, tension is created when the tubing is moved forward through the output holder by its own elongation which is not allowed to reverse. There are various embodiments of the input and output holders that are within the scope of the present invention, but they need to have a mechanism that keeps the tube(s) in tension relative to the output rollers. When a suck-back cycle is used, the tension device of the present invention holds the tubing from moving back toward the pump rollers.

Particular embodiments of the tension device of the invention can optionally have a ratchet mechanism that stops the tubing from moving backwards toward the peristaltic rollers. Another embodiment is where a gear type device is used with the tubes where, on the input side they are locked, and on the output side, they can allow the tube to move through the gears but not to move back due to the non-reversing of the output mechanism.

In various embodiments of the invention, tubing can be added so that the input and/or output can have a Y-connector that is not under stress. Also, the tubing can be single individual tubes or can be combined with tubing of a different diameter after the holders. For example, ¼ inch tube as an OD of 5/16 inch onto which 5/16 ID tubing can be bonded at a fixed distance between the two stops.

The tube holder of the present invention can be made of spring material so that the slots can be on cantilevered on spring stainless steel or equivalent material. While any rigid, elastic material can be used, but spring stainless steel is preferred.

Turning to FIG. 1, a prior art peristaltic pump can be seen in a top-down perspective view. The pump body 100 supports a series of rollers 200 through which tubing is threaded. Successive compression of the tubing between the rollers 2 and a shoe cause fluid to be pumped through the device.

Figure 2:
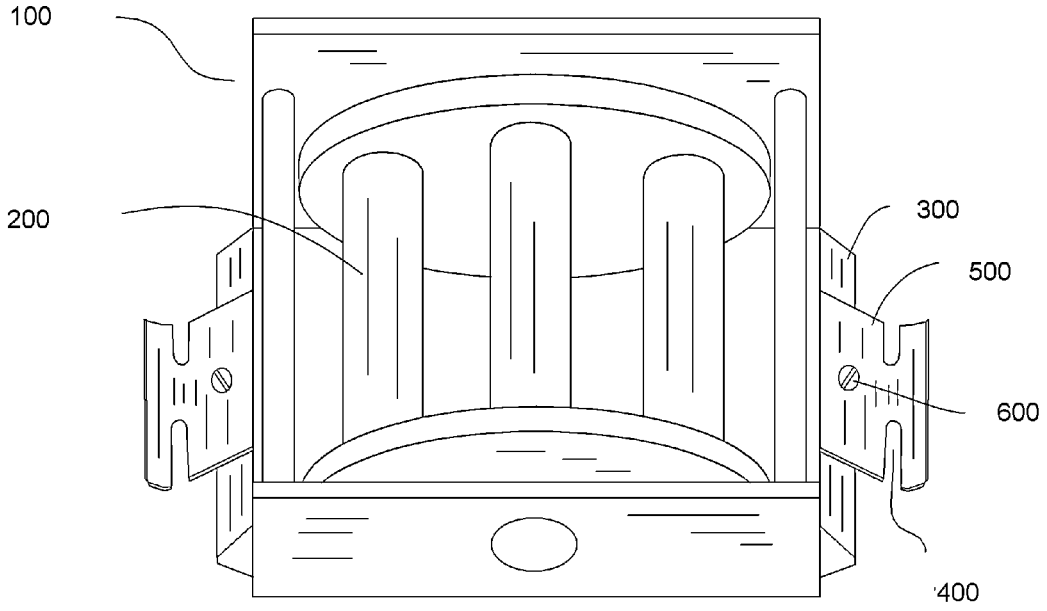
FIG. 2 shows an embodiment of the present invention attached to the pump of FIG. 1

FIG. 2 shows an embodiment of the present invention in the pump of FIG. 1 without any tubing. A spring steel tube holder 500 can be installed on part 300 of the frame at both the input and output sides of the pump. FIG. 2 shows installation with a screw 600; however, any fastening means is within the scope of the present invention. The tube holder 500 can have a elongated slot 400 on each side for, in this case, two tubes. The tube-holder 500 can be concave upward in a preferred configuration; however, any other configuration is within the scope of the present invention. Embodiments of the present invention can have one, or any number of slots or other holding means for any number of tubes.

Figure 3:
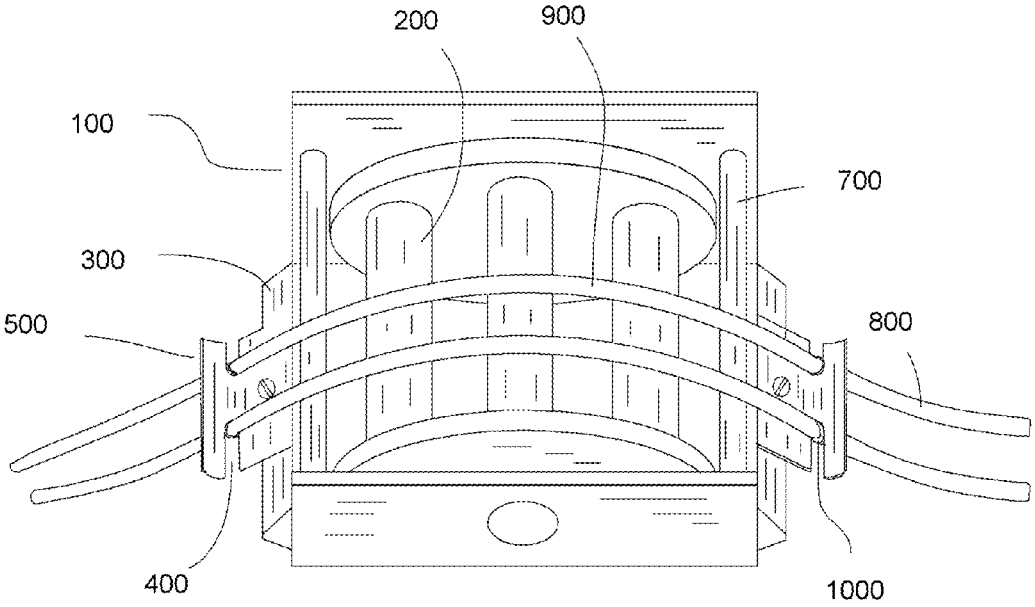
FIG. 3 shows the embodiment of FIG. 2 with tubing installed.
Figure 4:
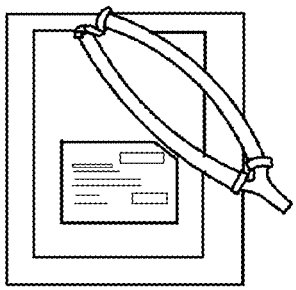
Prior Art Fig. 4
FIG. 4 shows "Y" type of peristaltic sets offered by Watson Marlow.
Figure 5:
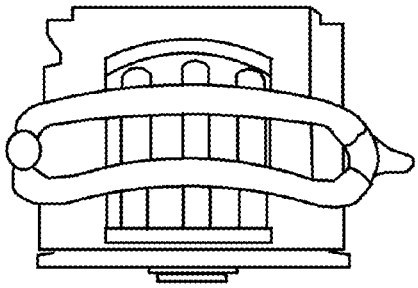
Prior Art Fig. 5
FIG. 5 shows stretched "Y" tubing set over fixed posts.
Figure 6:
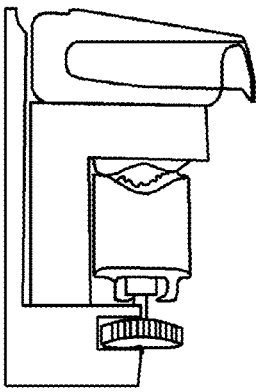
Prior Art Fig. 6
FIG. 6 shows adjustable inlet and outlet tube clamps.

FIG. 3 shows the embodiment of FIG. 2 with two tubes 800 installed. In this particular example, a larger tube 800 has been inserted 1000 over a smaller tube 900 at the slot 400 in the holder 500. This is completely optional and for convenience. Single tubes of constant OD, or any number of tube size changes are within the scope of the present invention. In any case, the input and output tube holders 500 function as previously described to cause an tremendous increase in the performance and accuracy of the peristaltic pump.

A tube holder has been designed that easily holds peristaltic tubing without reducing the tube ID and can use a small or longer section of a second tube that can be bonded to the outside diameter of the pump tube. These tubes allow the peristaltic tube to be easily loaded into the pump and can be used with the tension devices. The present invention provides a spring loaded input and output tube holder for peristaltic pump tubing that will provide a tension while holding the tubing in an elongated position. The tube holder provides for a constant tension on the tubing without allowing a backward slipping.

A particular embodiment of the present invention is a tube holding device for a peristaltic pump that allows for elongation of peristaltic pump tubing without letting the tubing move backward that includes a frame holding a peristaltic pump, a pair of substantially cylindrical roller gears mounted on the frame, the roller gears having longitudinal teeth or being knurled, and positioned to cooperate with the peristaltic pump by clamping a peristaltic pump tube between them. At least one of said roller gears can be attached to a negator spring located in a string pot where the negator spring assists in providing force between said roller gears for small tubing. The device can have a tube-holding member attached to the frame where the tube-holding member is concave to cause the tubing to center on the roller gears.

Figure 7:
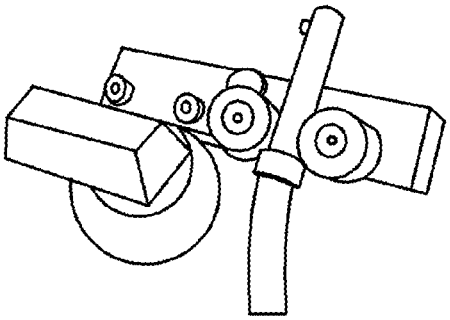
FIG. 7 shows a vertical direction sanding disc holding device.

In this embodiment, located on two 1/8 316 inch shoulder screws, can be two roller clutches, stock drive parts S99NH3-URCo204. Delrin spacers to Dremmel standard sanding discs to complete the assembly. The distance between the two rollers allow the tubing to elongate, but not move backward toward the peristaltic rollers. Laboratory tests show that it takes approximately three cycles to elongate the silicon tubing. The tubing is held in this position until the operator opens the pump. This is shown in FIG. 7. The configuration can be in the vertical direction or can be in the horizontal direction as shown in FIG. 8.

Figure 8:
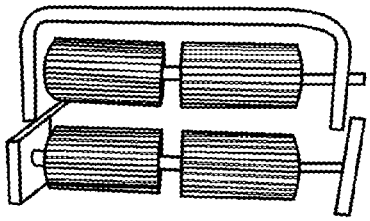
FIG. 8 shows a horizontal holding device orientation.
Figure 9:
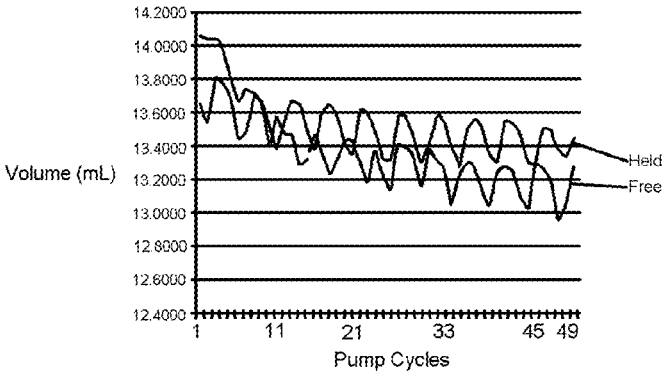
FIG. 9 is a graph showing settling time differences for "Y" (free) and compensated elongation (held).

The configuration shown in FIG. 8 has been tested in the laboratory, and the settling time for peristaltic tubing can be directly seen in the graph, FIG. 9. The extension of the peristaltic tube requires approximately three pump cycles. Data was taken for 50 pump cycles after the "y" configuration, and holding system for each system was primed. The corresponding fluid weights were recorded using a Sartoris BP 121S 4 place scale for each volume of water dispensed. The data using the "load & go" breadboard hardware has a faster settling time compensating for tubing elongation.

The "held" data represents the gear rollers compensating for each cycle of tube extrusion. The "free" data represents the "y" tubing mounted on posts. Peristaltic pumps can take advantage of using the holding device defined in the patent application. The drawing below is a prototype design with the holding gear elements. There are two separate holding mechanisms at the input and exit of the peristaltic pump due to the fact that the 505L peristaltic pump has offset pressure shoes that minimizes pulsating fluid flow.

Figure 10:
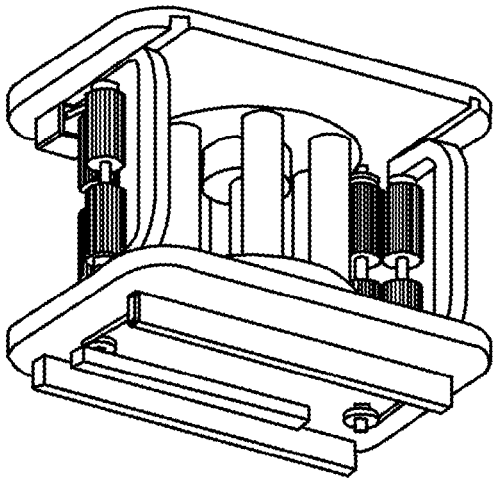
FIG. 10 shows overall peristaltic pump assembly with the cover shoes removed.

FIG. 10 shows the assembly of these embodiments without the peristaltic pressure shoe plate being shown. The plate was removed so that the internal holding elements can be seen. The movable bars shown on the outside plate are mechanical levers that lock a shaft and allow for the loading of negator springs. The two yokes represent elements that can be removed when loading peristaltic tubing. Each plate slot is sized so that the correct orientation of the gear holders is assured.

Figure 11:
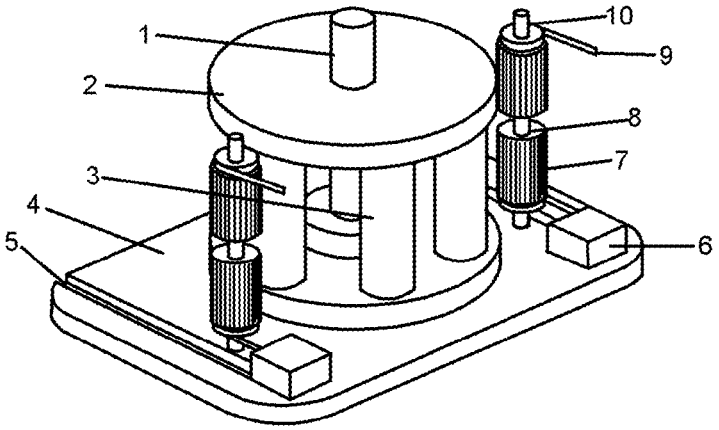
FIG. 11 shows a mechanism view with shoes, yokes and motor plates removed.

The gear rollers 7 shown in FIG. 11 are the tube holding components that secure the peristaltic tubing. The gears 7 can have centering depressions located at the center of the gear components that assist in controlling the tubing position if the pump orientation is put into a vertical configuration. In each end of the gear component are pressed a roller clutches 8, (Stock drive parts S99NH3-URCo204). The orientations of the roller clutches 8 need to be positioned so that the assembly can only move in one direction and restrict the motion in the opposite direction when assembled with the bearing shaft 10. The number of roller clutches in the full assembly could be as many as sixteen, but can be a few as four depending on the configuration. The case of four clutches would represent where only one clutch is used for each gear segment that is not in the removable section. If there were two clutches in each gear segment times the number of segments, the result is sixteen clutches. The motor driven peristaltic pump 1 shaft 2 and rollers 3 can be seen. The rollers 3 shown here are six in number but can vary. The cover plate 4 opposite the motor driven cover plate can be seen. The motor plate provides mounting for shafts 1, 10 which is not shown in this view. String pots 6 which can be GFI Technologies MTA or equivalent string pots) provide for the elongation measurement as seen by the gear rollers 3. These string pots 6 also have negator springs that provide assist to smaller diameter peristaltic tubing that do not represent adequate elongation forces to feed into the mechanism. The grooves 5 on the other end of the plate are different in size so as to orient the top rollers shown in FIG. 12. FIG. 11 does not show the gear rollers supported by yokes that slide in the slot 5.

When the top cover is put in place, it adjusts the two pressure shoes for the peristaltic pump and also adjusts the yoke downward force as the thumb screw is adjusted. The holding yoke for the upper rollers slides in the side plate grooves and the tube adds adequate resistance so the rollers would need to be held down.

Each of the holding mechanisms has two input and exit ⅛ 316 stainless steel rods (62320445 MSC) 10 on which there are two roller clutches (S99NH3-URCO204 Stock Drive Products) 8 for each gear roller being used. The laboratory system uses ½ inch brass gear stock with 32 teeth 7; however, any gear stock may be used. The gear stock can be replaced with a knurled surface or any structure that would hold the peristaltic tubes. The surface may be concave toward the middle of each roller set, and it is limited to the smallest tube being held correctly. If the rollers are switched out, the curvature can be optimized for each type and diameter of tubing. The top set of rollers is adjustable so that the distance between the top and bottom rollers may vary. Each peristaltic tube diameter is able to increase the distance between the top and lower rollers, but the pump cover attached to the pump assembly provides for an input and exit positioning screw defining the amount of force exhibited on the tubing.

Figure 12:
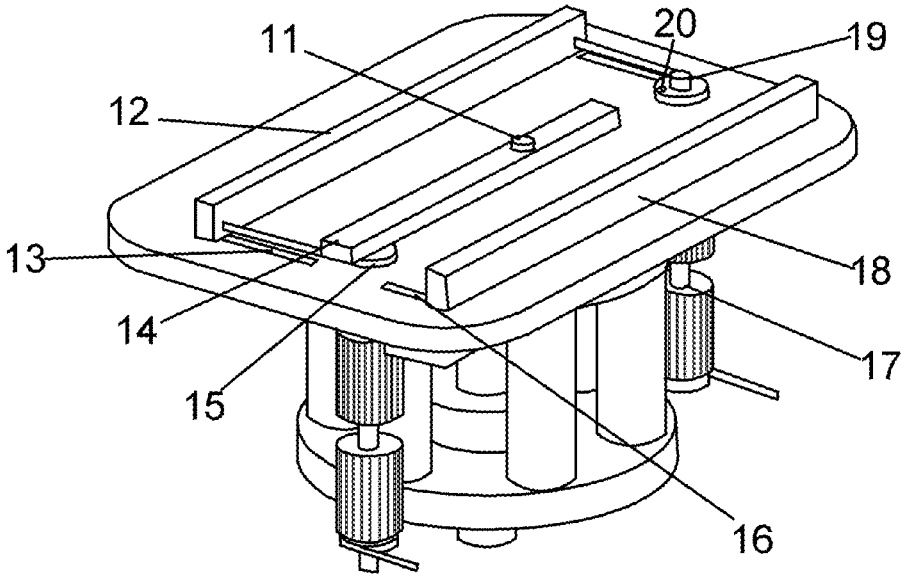
FIG. 12 shows the mechanism of FIG. 11 turned upside down.

FIG. 12 shows the upside-down view where the operator interacts with the locks and levers. The bar 14 with locking button 11 locks and unlocks shaft 19. The pin is moved in and out of the shaft providing the lock of free configurations 20. A negator 15 spring is attached to the shaft 10 and is used to rewind the pot leading string. The sequence of events that the operator performs are:

1. Assure that the shaft 19 is in the locked position;
2. Load the peristaltic tubing and insert top yokes and shoe cover plate;
3. Adjust the yoke downward force if not already accomplished;
4. Move lever 18, which loads the string pot negator springs, outward and lock in place;
5. Move lever 12, which loads the shaft negator spring, outward and lock in place
6. Prime and run the peristaltic pump until the lot is finished or the tube measurements indicate a tube change is needed;
7. Remove the shoe plate, two yokes and peristaltic tubing;
8. Unlock and move lever 18 inward;
9. Unlock the shaft 19 and let the negator shaft spring rewind the string pot string;
10. Unlock lever 12 to move the lever inward;
11. Lock shaft 19, and repeat starting at 1. above The clutch mechanisms of the present invention are mechanical, but they could be replace with motors or solenoids.

Several descriptions an illustrations have been provided to aid in understanding the present invention. One of skill in the art will realize that numerous changes and variations are possible without departing from the spirit of the invention. Each of these changes and variations is within the scope of the present invention.

We claim:

1. A tube holding device for a peristaltic pump that allows elongation of peristaltic pump tubing, but prevents it from moving backward comprising:

a frame holding a peristaltic pump;

a first pair of substantially cylindrical roller gears on roller clutches mounted on said frame, said roller gears having longitudinal teeth and positioned to cooperate with said peristaltic pump by clamping a peristaltic pump tube between them;

at least one of said roller gears attached to a negator spring located in a string pot, said negator spring assisting in providing force between said roller gears for small tubing.

2. The holding device of claim 1 adapted to be used with either rotary of linear types of peristaltic pumps.

3. The holding device of claim 1 further comprising a second pair of roller gears opposite said first pair, wherein said first pair is located at an input of said peristaltic pump and the second pair is located at an output of said peristaltic pump.

4. The holding device of claim 1 wherein said roller gears can be removed.

5. The holding device of claim 1 wherein said clutches are motors.

* * * * *